US009474374B2

(12) United States Patent
Reinhart

(10) Patent No.: US 9,474,374 B2
(45) Date of Patent: Oct. 25, 2016

(54) MODULAR SHELVING

(71) Applicant: Creative Plastic Concepts, LLC, Sycamore, OH (US)

(72) Inventor: Nickolas Reinhart, Findlay, OH (US)

(73) Assignee: CREATIVE PLASTICS CONCEPTS, LLC, Sycamore, OH (US)

( * ) Notice: Subject to any disclaimer, the term of this patent is extended or adjusted under 35 U.S.C. 154(b) by 0 days.

(21) Appl. No.: 14/730,527

(22) Filed: Jun. 4, 2015

(65) Prior Publication Data

US 2015/0351540 A1 Dec. 10, 2015

Related U.S. Application Data

(60) Provisional application No. 62/008,186, filed on Jun. 5, 2014.

(51) Int. Cl.

| | |
|---|---|
| ***A47B 96/02*** | (2006.01) |
| ***A47B 47/00*** | (2006.01) |
| ***A47B 96/06*** | (2006.01) |
| ***A47B 47/04*** | (2006.01) |
| ***A47B 87/02*** | (2006.01) |

(52) U.S. Cl.

CPC ..... *A47B 96/024* (2013.01); *A47B 47/0091* (2013.01); *A47B 47/045* (2013.01); *A47B 87/0223* (2013.01); *A47B 96/021* (2013.01); *A47B 96/06* (2013.01)

(58) Field of Classification Search

CPC .. A47B 96/024; A47B 96/021; A47B 96/06; A47B 47/0091; A47B 87/0223; A47B 47/045

USPC ..... 211/186

See application file for complete search history.

(56) References Cited

U.S. PATENT DOCUMENTS

| | | | | | |
|---|---|---|---|---|---|
| 3,927,769 | A * | 12/1975 | Maslow | F26B 25/18 | 108/156 |
| 4,158,336 | A * | 6/1979 | Brescia | A47B 87/0215 | 108/156 |
| 4,615,278 | A * | 10/1986 | Cabrelli | A47B 57/265 | 108/147.13 |
| 4,621,740 | A * | 11/1986 | Lang | A47B 87/0223 | 211/126.12 |
| 4,706,576 | A * | 11/1987 | James | A47B 57/545 | 108/106 |
| 4,953,719 | A * | 9/1990 | Spamer | A47B 87/0223 | 211/188 |
| 5,158,187 | A * | 10/1992 | Taub | F16B 12/20 | 108/185 |
| 5,238,128 | A * | 8/1993 | Stoddard | A47F 5/005 | 211/133.1 |
| 5,964,163 | A * | 10/1999 | Cohen | A47B 49/004 | 108/186 |
| 6,079,339 | A * | 6/2000 | Houk, Jr. | A47B 87/0223 | 108/157.13 |
| 8,042,477 | B2 * | 10/2011 | Lee | A47B 57/54 | 108/109 |
| 2003/0146180 | A1 * | 8/2003 | Craft | A47B 87/0223 | 211/188 |
| 2004/0159622 | A1 * | 8/2004 | Craft | A47B 87/0246 | 211/153 |

* cited by examiner

*Primary Examiner* — Korie H Chan

(74) *Attorney, Agent, or Firm* — Fraser Clemens Martin & Miller LLC; Jacob M. Ward

(57) ABSTRACT

A shelf assembly includes a shelf main body. The shelf assembly further includes a plurality of corner connectors releasably coupled to the shelf main body. Each of the corner connectors is configured to receive at least one post. Each of the corner connectors also has an insert for coupling the corner connectors to the shelf main body.

15 Claims, 13 Drawing Sheets

MODULAR SHELVING

CROSS REFERENCE TO RELATED APPLICATIONS

This application claims the benefit of U.S. Provisional Application Ser. No. 62/008,186, filed on Jun. 5, 2014. The entire disclosure of the above application is hereby incorporated herein by reference.

FIELD

The disclosure generally relates to modular shelving systems and, in particular, modular shelving systems having shelf members that are nestable.

BACKGROUND

Modular shelving systems are known for storing and supporting items and products of all types. Typically, modular shelving systems contain a number of components that can be easily assembled to conform to a customer's needs. Known modular shelving systems can include shelf members, support posts, and connectors, for example. These components are often shipped disassembled. The modular shelving systems can then be easily assembled at their desired location.

When shipping or storing modular shelving systems, the shelf members are usually stacked upon each other. However, known shelf members often have features that militate against a nesting of the shelf members when stacked. For example, retaining features for receiving the support post in certain shelf members can prevent the nesting of the shelf members when stacked. This causes known modular shelving systems to occupy an undesirable amount of space when shipped and stored, which in turn results in higher transportation and storage costs.

Additionally, because a customer typically assembles the modular shelving system on site, it is desirable for the components to be lightweight. However, when forming lightweight shelving, the strength and reinforcement of the shelving system has been a concern.

There is a continuing need for a modular shelving system with components that are nestable when stacked. Desirably, the nestable components minimize shipping and storage costs, while also maximizing the strength and reinforcement of modular shelving systems when assembled.

SUMMARY

In concordance with the instant disclosure, a modular shelving system with components that are nestable when stacked, and which minimizes shipping and storage costs while also maximizing the strength and reinforcement of modular shelving systems when assembled, is surprisingly discovered.

In an illustrative embodiment, a shelf assembly includes a shelf main body. The shelf assembly further has a plurality of corner connectors releasably coupled to the shelf main body. Each of the corner connectors is configured to receive at least one post.

In another embodiment, a kit for a shelf assembly includes a plurality of shelf main bodies. The shelf main bodies are configured to be nestable with each other. The kit further includes a plurality of corner connectors and a plurality of posts. Each of the corner connectors is configured to receive at least one post.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
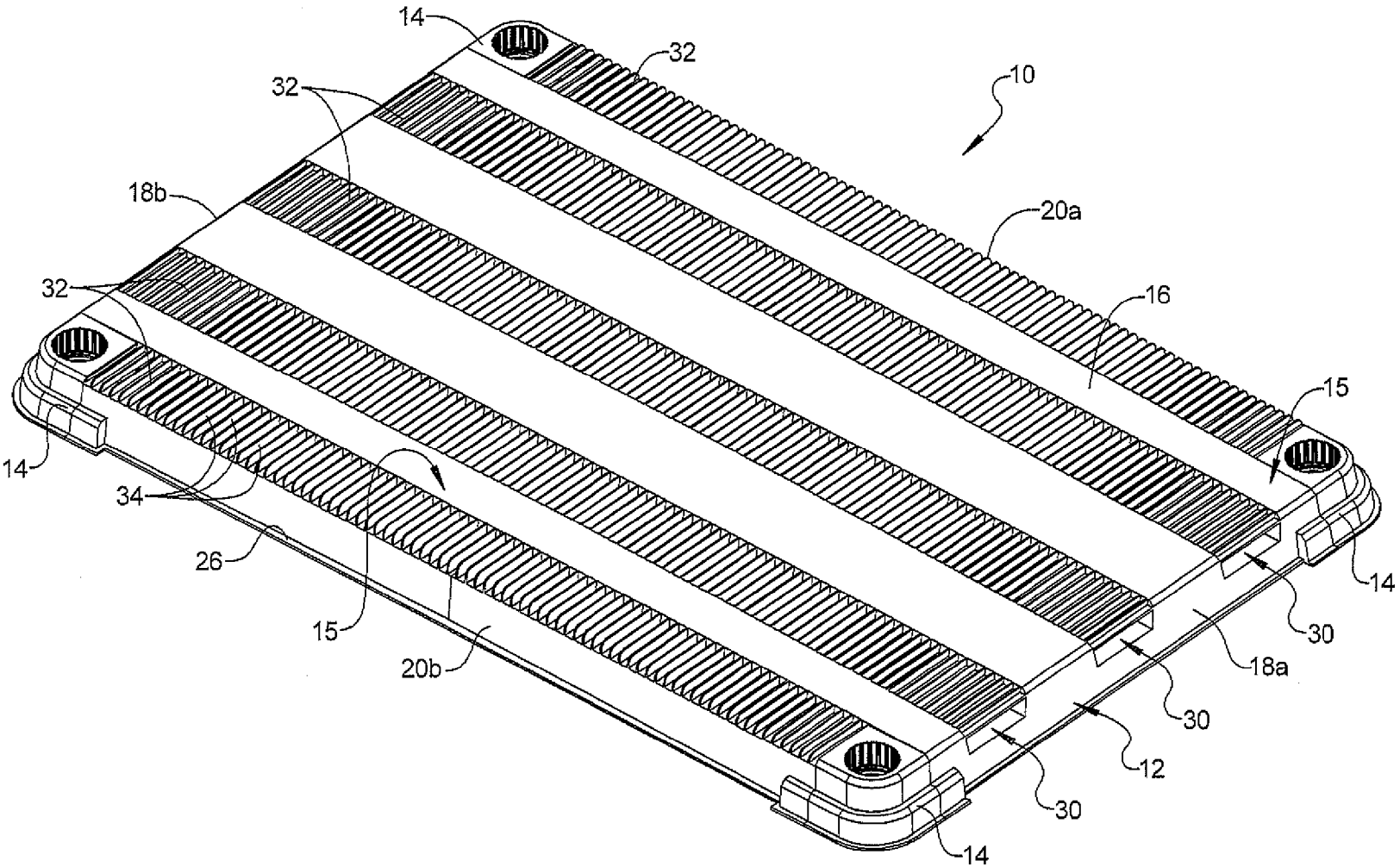
FIG. 1 illustrates a top perspective view of a shelf assembly according to an aspect of the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

FIGS. 1-4 illustrate a shelf assembly 10 for use in a modular shelving system according to an embodiment of the disclosure. The shelf assembly 10 is configured to cooperate with other components such as support posts, for example, to form the modular shelving system. All dimensions and materials identified are merely illustrative in nature, and should not be considered limiting unless otherwise disclosed.

The shelf assembly 10 includes a shelf main body 12 and a plurality of corner connectors 14 releasably coupled to the shelf main body 12. The shelf assembly 10 may be substantially rectangular and have four corners, for example. Other shapes for the shelf main body 12 may also be selected by a skilled artisan within the scope of the present disclosure.

The corner connectors 14 are positioned at each of the corners of the shelf main body 12. The shelf main body 12 and the corner connectors 14 of the shelf assembly 10 may be formed from a lightweight material such as polypropylene, for example, by an injection molding process. It should be understood that the shelf main body 12 and the corner connectors 14 of the shelf assembly 10 can be formed from any suitable material, including other thermoplastic materials such as polyethylene, for example, and non-thermoplastic materials such as foam or metal, for example. Any suitable process for forming the shelf main body 12 and the corner connectors 14 may also be employed, as desired.

Figure 2:
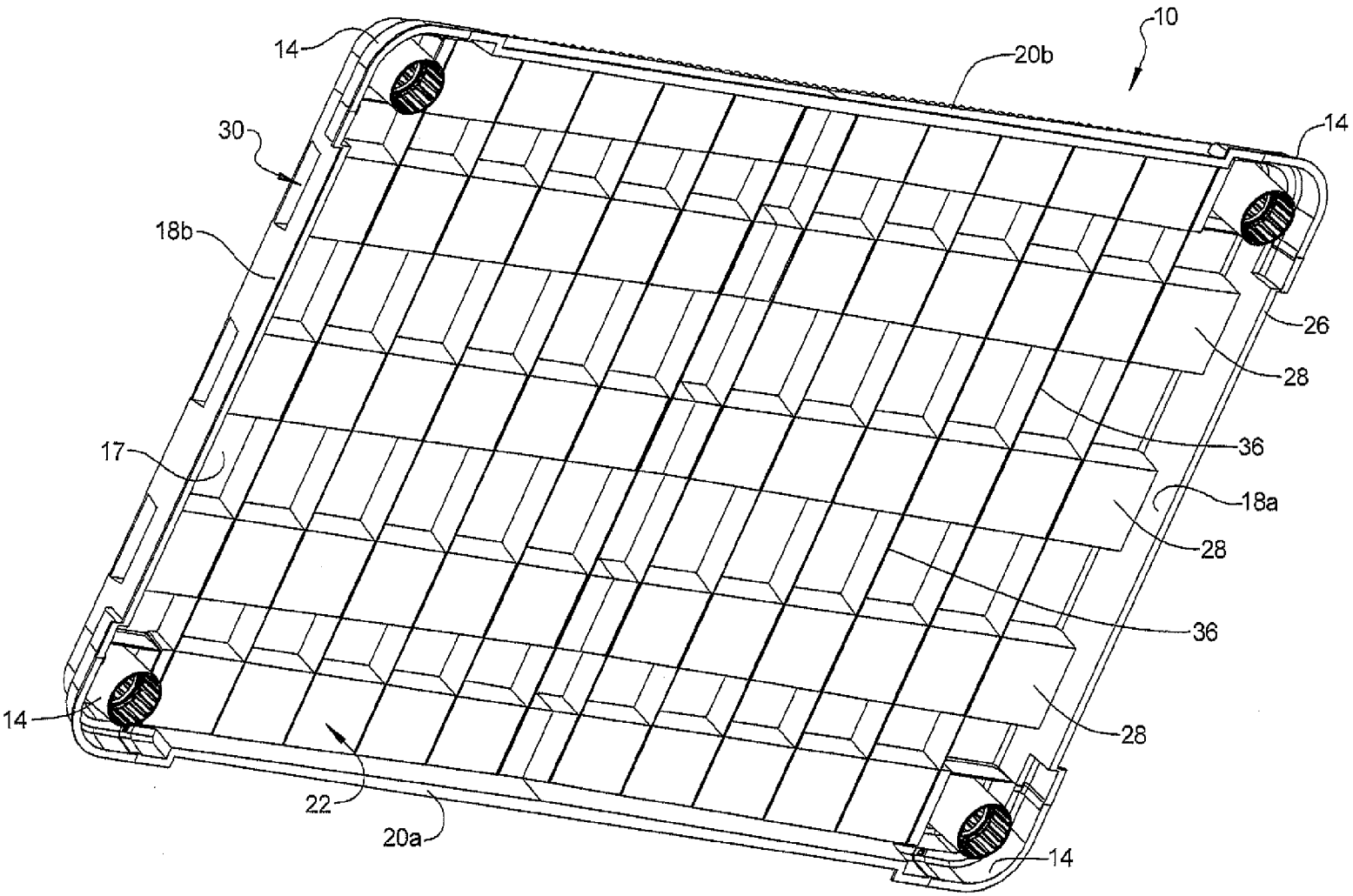
FIG. 2 illustrates a bottom perspective view of a shelf assembly according to an aspect of the present disclosure.
Figure 3:
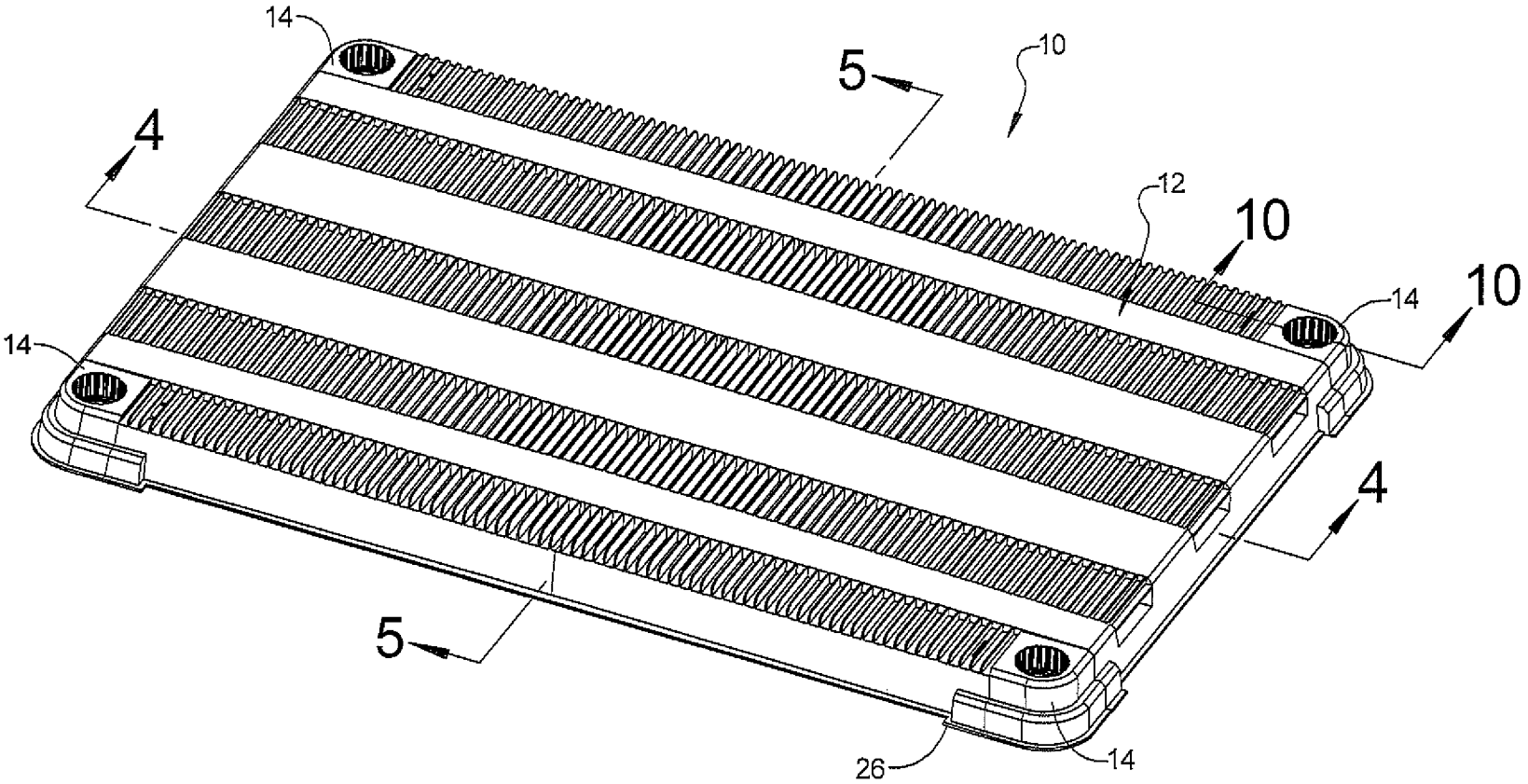
FIG. 3 illustrates another top perspective view of the shelf assembly shown in FIGS. 1-2, further shown with section lines relating to subsequent drawings.

The shelf main body 12 includes a platform 16 having an upper surface 15 and a lower surface 17 as shown in FIG. 2. A pair of opposing first walls 18*a*, 18*b* are integrally formed with and extend from the platform 16. A pair of opposing second walls 20*a*, 20*b* are integrally formed with and extend from the platform 16. The first walls 18*a*, 18*b* and second walls 20*a*, 20*b* can individually extend from the platform 16 at an outwardly extending angle therefrom. The angle selected facilitates a nesting of multiple successive shelf main bodies 12 when stacked.

Figure 7:
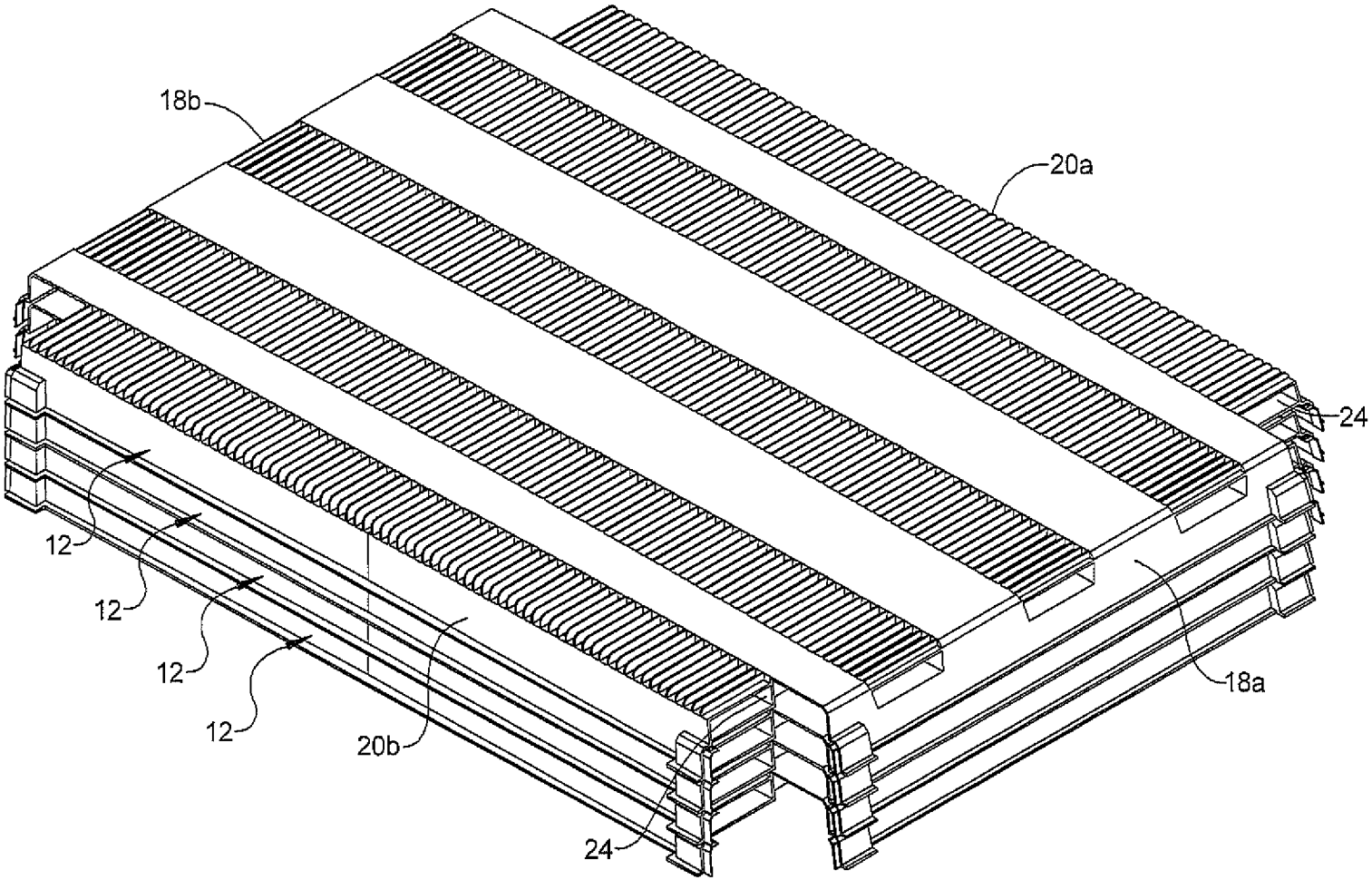
FIG. 7 is a top perspective view of a stack of shelf main bodies shown nested and without the corner connectors, each of the shelf main bodies used to form a shelf assembly as depicted in FIGS. 1-6.
Figures 8A, 8B, 8C, 8D:
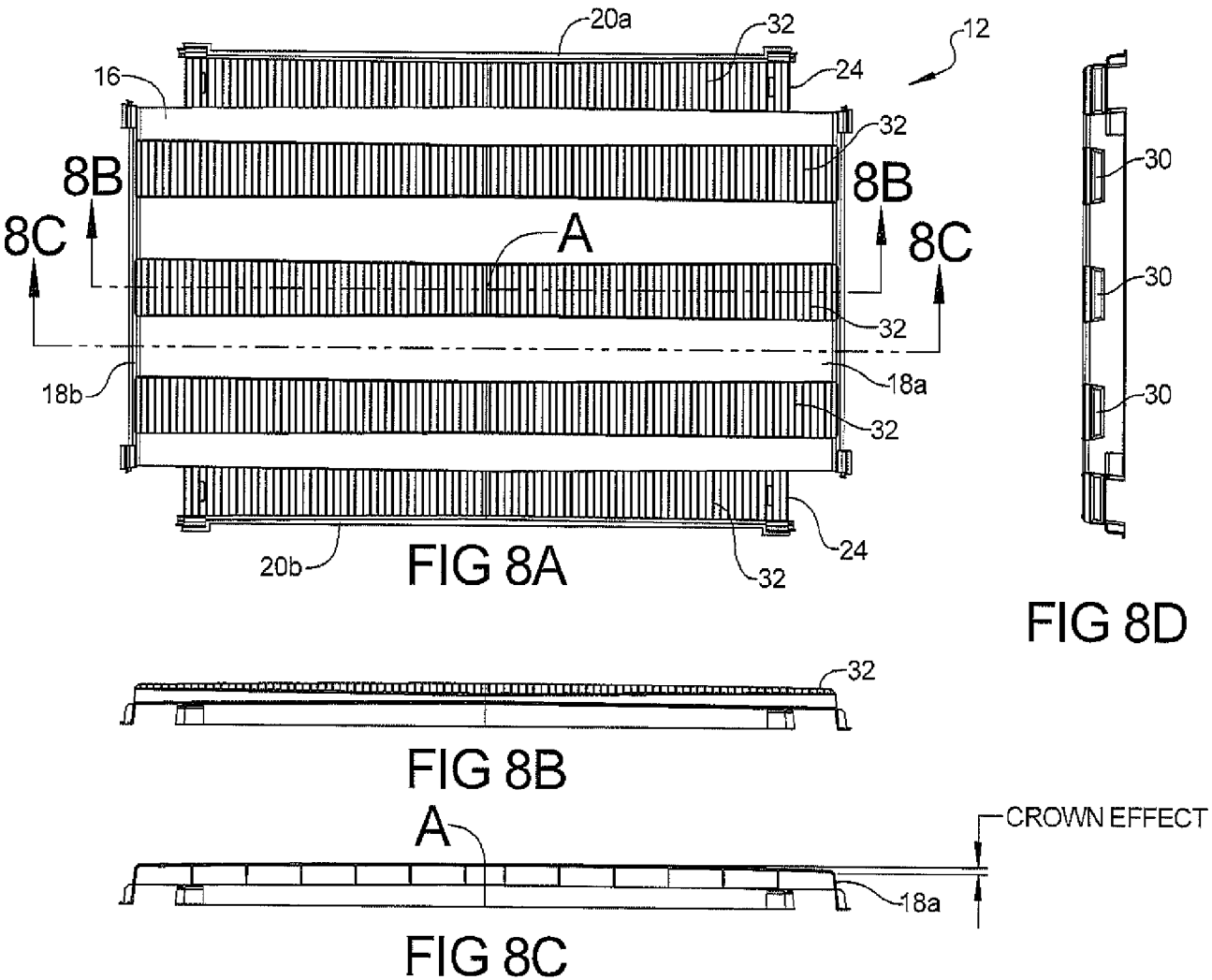
FIG. 8A is a top plan view of the shelf main body of FIGS. 1-3.
FIG. 8B is, a cross-sectional view taken along section line 8B of FIG. 8A.
FIG. 8C is a cross-sectional view taken along section line 8C of FIG. 8A.
FIG. 8D is a right side elevational view of the shelf main body of FIG. 8A.

The lower surface 17 of the platform 16, the first walls 18*a*, 18*b*, and second walls 20*a*, 20*b* together define a cavity 22, as shown in FIG. 2. Multiple recesses 24 are formed at opposing ends of each of the first walls 18*a*, 18*b*, as shown in FIGS. 7-8. The recesses 24 are provided to slidingly receive an insert of the corner connectors which is described in greater detail in reference to FIGS. 9-10. In certain aspects, the first walls 18*a*, 18*b* and the second walls 20*a*, 20*b* extend from the platform 16 and terminate at a lip 26 extending outwardly from the shelf main body 12, as shown in FIGS. 1-2. The lip 26 is provided to stiffen and reinforce the shape of the shelf main body 12, particularly when the corner connectors 14 are not yet connected to the shelf main body 12.

The shelf main body 12 further includes box supports 28 integrally formed with the lower surface 17 of the platform 16. The box supports 28 extend between and are disposed substantially normal to the opposing first walls 18*a*, 18*b*. As clearly visible in FIG. 4, the box supports 28 are hollow, and are provided to add reinforcing stiffness to the shelf main body 12 while minimizing a weight impact to the shelf main body 12. Openings 30 at the ends of the box supports 28 are formed in the first walls 18*a*, 18*b*. In certain aspects, the openings 30 have a substantially rectangular shape. In other aspects, a draft is employed when forming the openings 30 to facilitate a molding process, for example.

As shown in FIG. 2, the shelf main body 12 can also include partitions 36 defining reinforcing walls interposed between each of the box supports 28 and disposed substantially normal to the opposing second walls 20*a*, 20*b*. The partitions 36 contribute to support and rigidity of the shelf main body 12 in operation.

Figure 4:
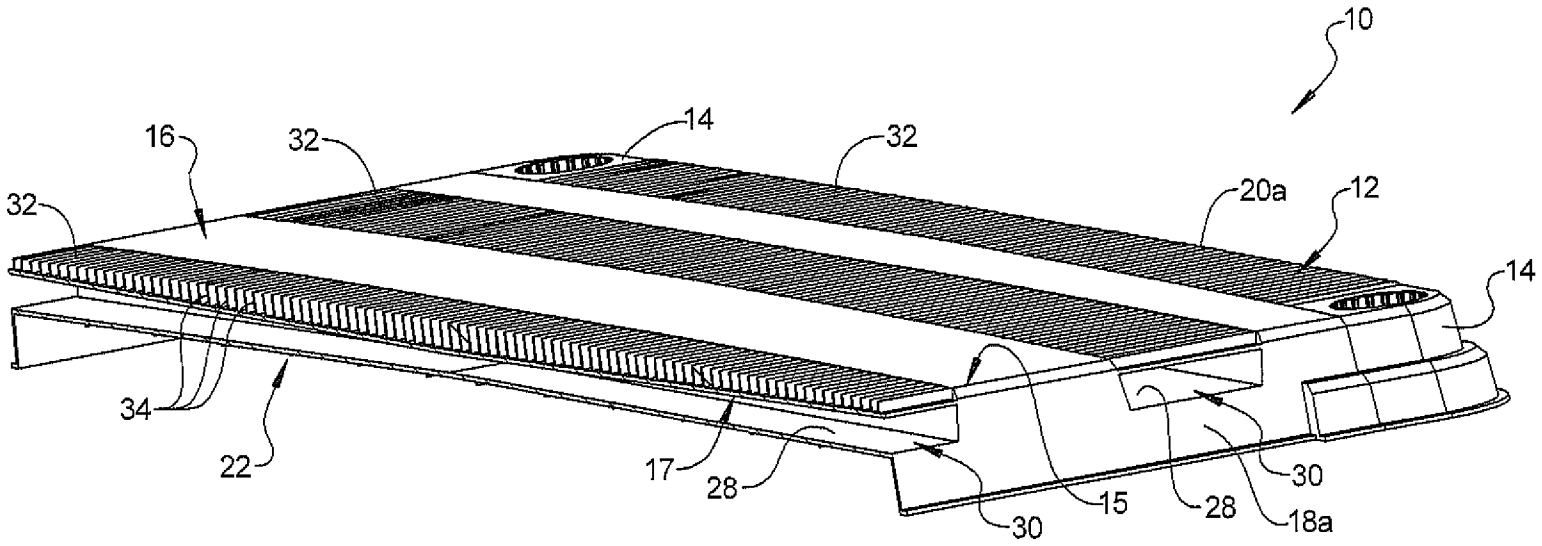
FIG. 4 is a fragmentary top perspective cross-sectional view of the shelf assembly taken along section line 4-4 in FIG. 3.
Figure 5:
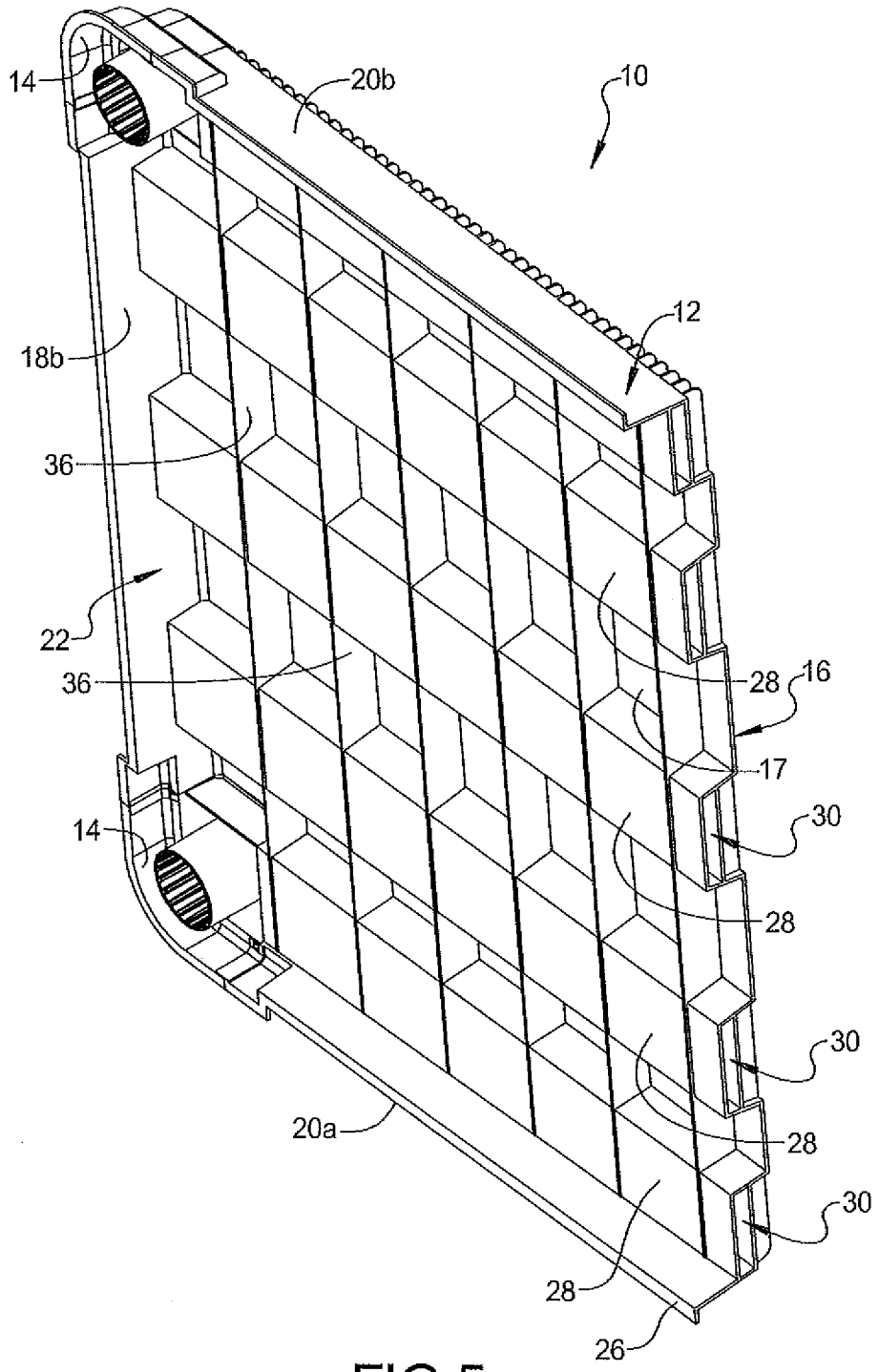
FIG. 5 is a bottom perspective cross-sectional view of the shelf assembly taken along section line 5-5 in FIG. 3.
Figure 6:
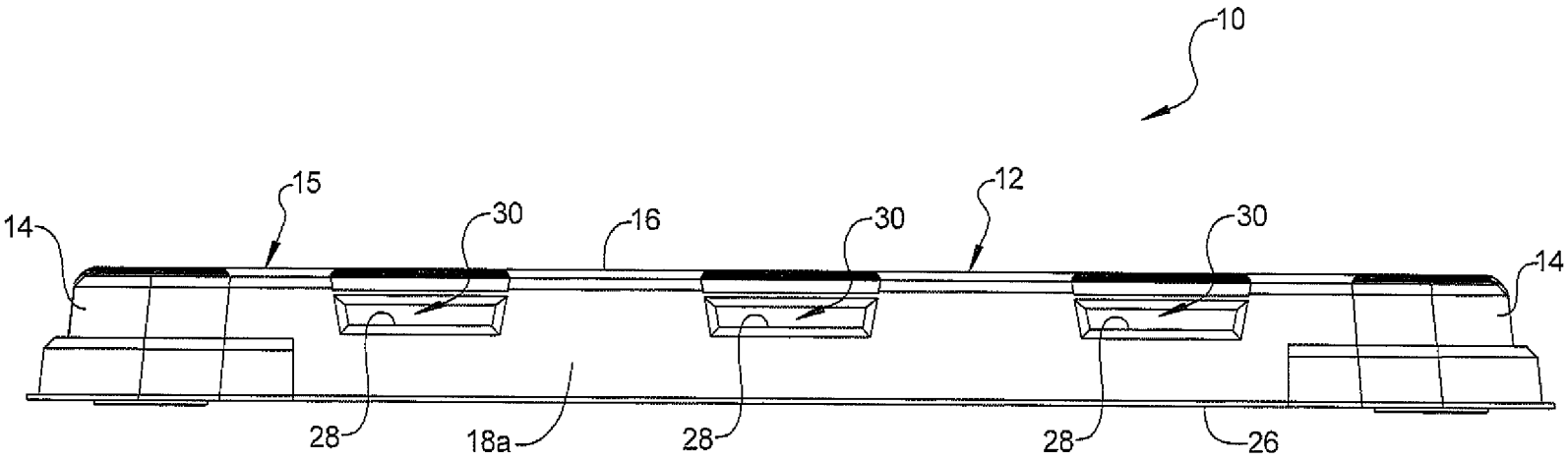
FIG. 6 is a left side elevational view of the shelf assembly of FIGS. 1-3.

The shelf main body 12 further includes reinforcing portions 32, as shown in FIGS. 1 and 4. The reinforcing portions 32 each include a plurality of spaced apart ribs 34 extending therefrom. The ribs 34 extend outwardly and upwardly from the upper surface 15 of the platform 16. In certain aspects, the ribs 34 may have a substantially rectangular shape. However, the ribs 34 can have any desired shape such as rectangular or ovular, for example. In certain aspects, the reinforcing portions 32 align with the box supports 28 that extend between the opposing first walls 18*a*, 18*b*. This configuration can advantageously conceal any draft formed from a molding process.

In certain aspects, as illustrated in FIGS. 8A-8D, the platform 16 of the shelf main body 12 has a crown effect. The crown effect results in the upper surface 15 being convex with a high point of the upper surface at a center "A" of the shelf main body 12 as represented by the height difference in the dimensioning lines in FIG. 8C. According to several aspects, the crown effect may be a difference in elevation (height) between the center "A" of the shelf main body 12 and one of the first or the second outer walls, for example the outer first wall 18*a*, with a height difference of approximately 0.38 cm (0.15 in). The crown effect advantageously affects a preload force, and militates against undesirable downward deformation of the shelf assembly 10 when loaded with products, in operation. Any suitable convex profile for the crown effect may be selected, as desired.

Referring now to FIGS. 9-12, the corner connectors 14 each include a housing 40 with an inner wall 42. The inner wall 42 defines an aperture 43, which is configured to receive and support posts (shown in phantom in FIG. 10) of the modular shelving system. The housing 40 also includes an outer wall 46 that partially envelopes the inner wall 42. The outer wall 46 is configured to align with the first walls 18*a*, 18*b* and the second walls 20*a*, 20*b* of the shelf main body 12 when coupled to the shelf main body 12. For example, one of the corner connectors has its outer wall 46 aligned with the first wall 18*a* and with the second wall 20*a*.

In certain aspects, the inner wall 42 includes protuberances 52 formed thereon. The protuberances 52 are aligned parallel to the inner wall 42 and are oriented substantially vertically upward when the corner connectors 14 are coupled to the shelf main body 12. The protuberances 52 facilitate a press fit or friction fit between the inner wall 42 and the posts $P_1$, $P_2$ of the modular shelving system shown in phantom in FIG. 10.

Figure 10:
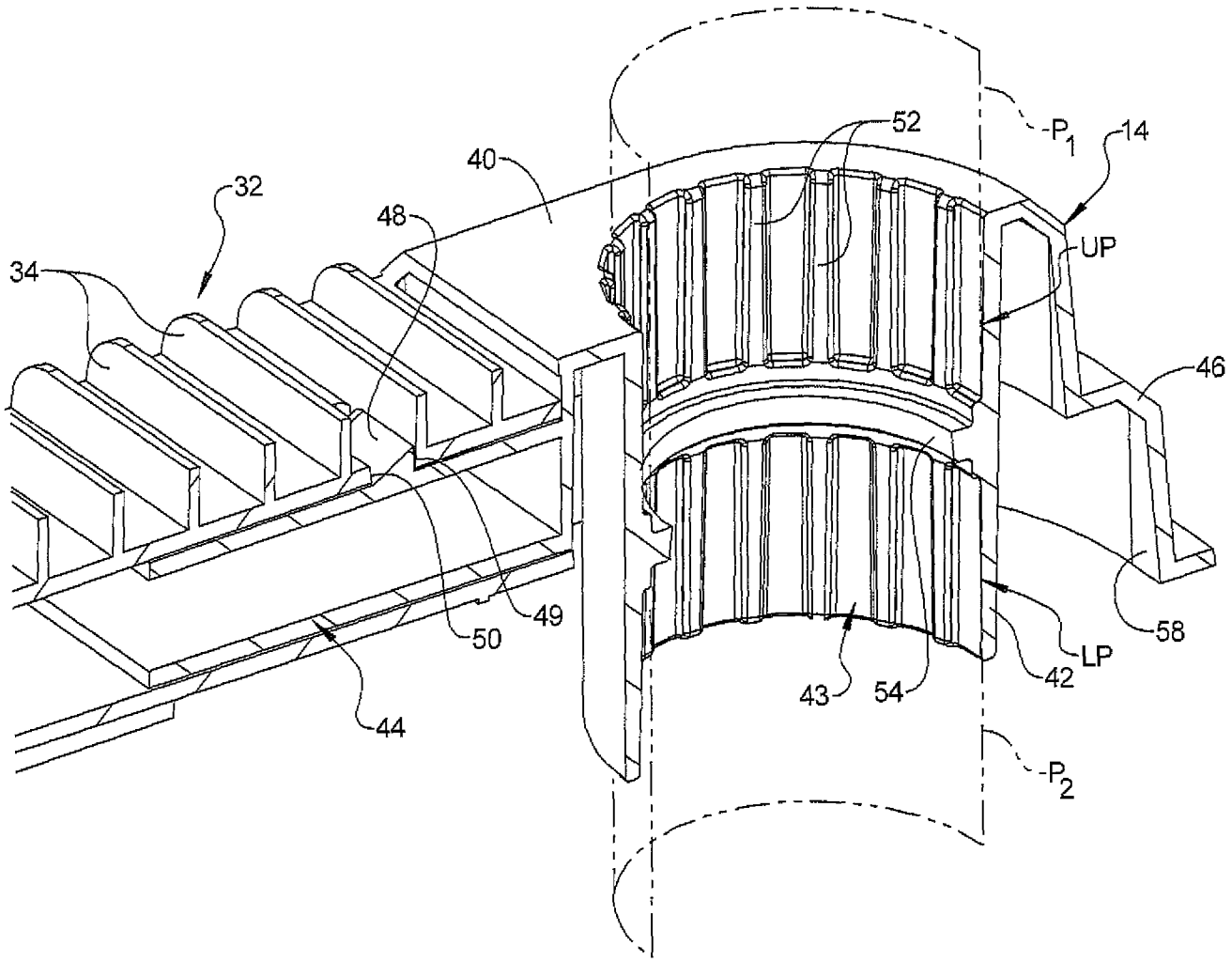
FIG. 10 is a cross-sectional view taken along section line 10 of FIG. 3.
Figure 11:
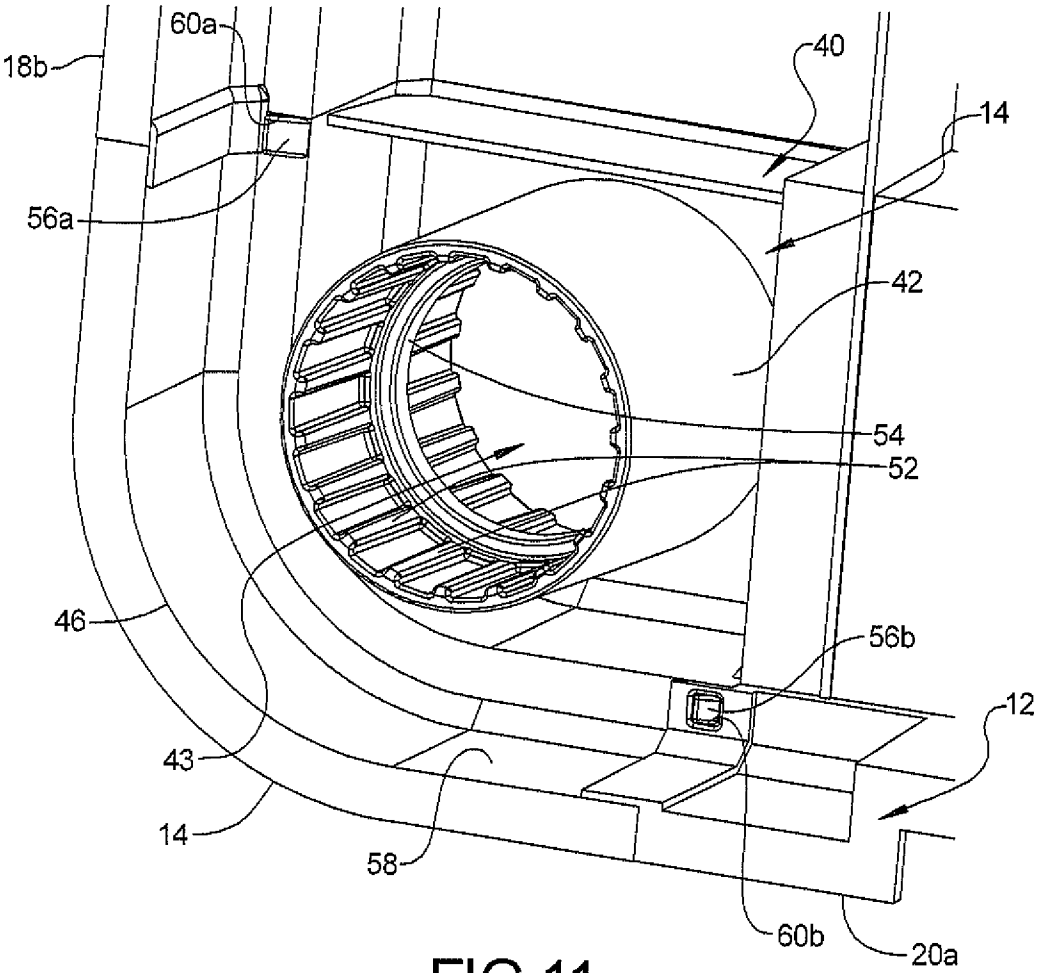
FIG. 11 is a bottom right perspective view of a corner connector of the shelf assembly shown in FIGS. 1-6.
Figure 12:
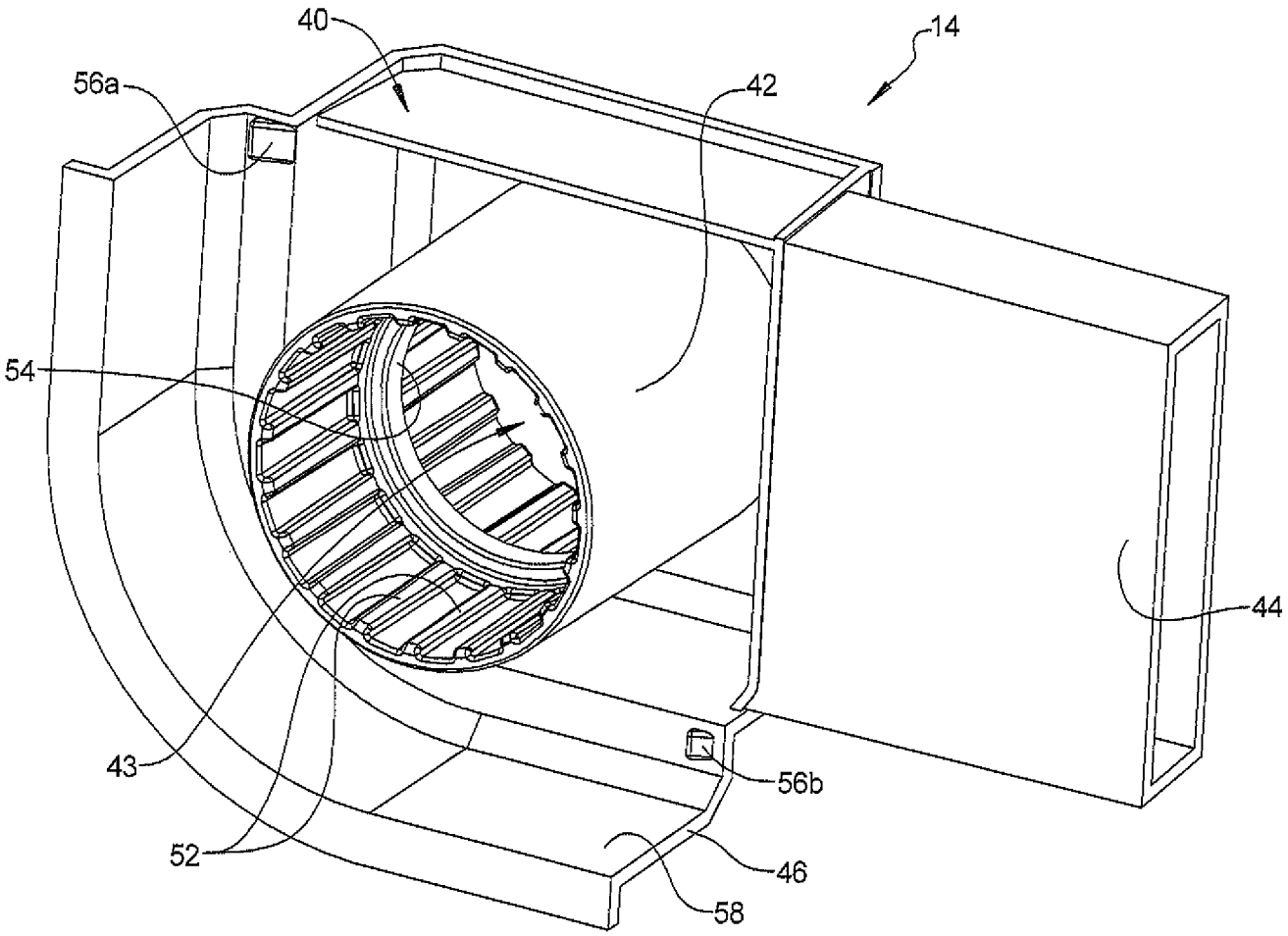
FIG. 12 is a top left perspective view of an installed corner connector of the shelf assembly shown in FIGS. 1-6.
Figure 13A:
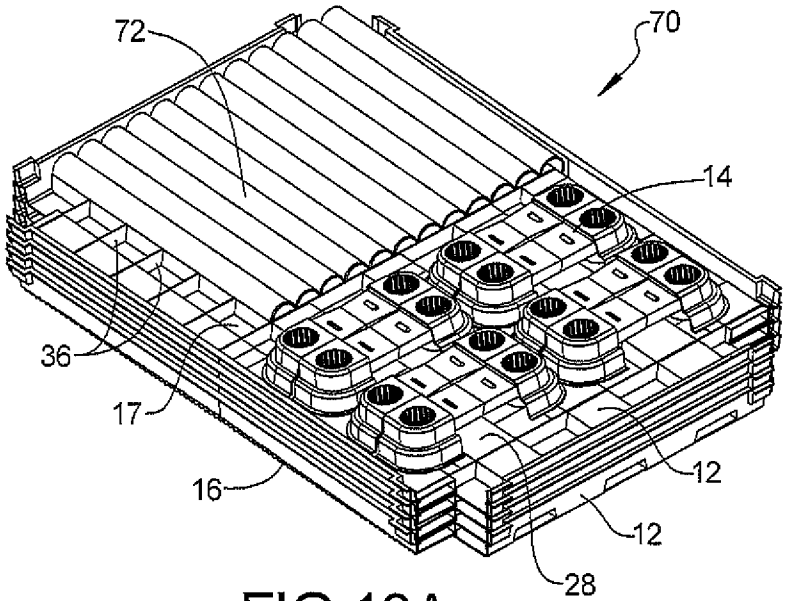
FIG. 13A is a top right perspective view of a modular shelving system kit according to an aspect of the invention, the kit shown stacked with the shelf main bodies nested and the corner connector disposed atop the stack.
Figure 13D:
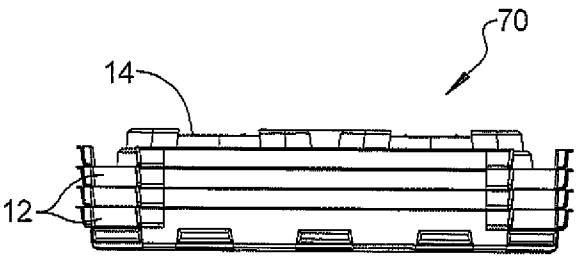
FIG. 13D is an end elevational view of the modular shelving kit of FIG. 13A.
Figure 13B:
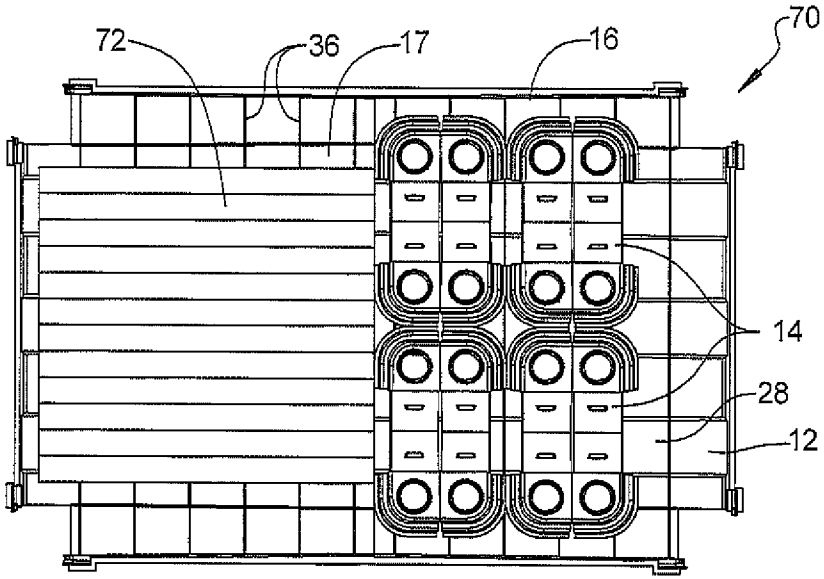
FIG. 13B is a top plan view of the modular shelving system kit of FIG. 13A.
Figure 13C:
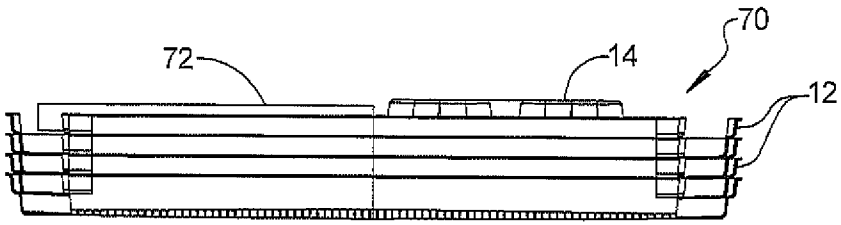
FIG. 13C is a front elevational view of the modular shelving kit of FIG. 13A.

As shown in FIGS. 10-12, the inner wall 42 may further have a ledge 54 formed thereon, and which extends radially inwardly from the inner wall 42. The ledge 54 separates the aperture 43 into an upper portion "UP" and a lower portion "LP". The upper portion "UP" of the aperture 43 is configured for receiving an end of one post, such as post $P_1$ of the modular shelving system. The lower portion "LP" of the aperture 43 is configured for receiving an end of the other post, such as post $P_2$ of the modular shelving system.

Figure 9:
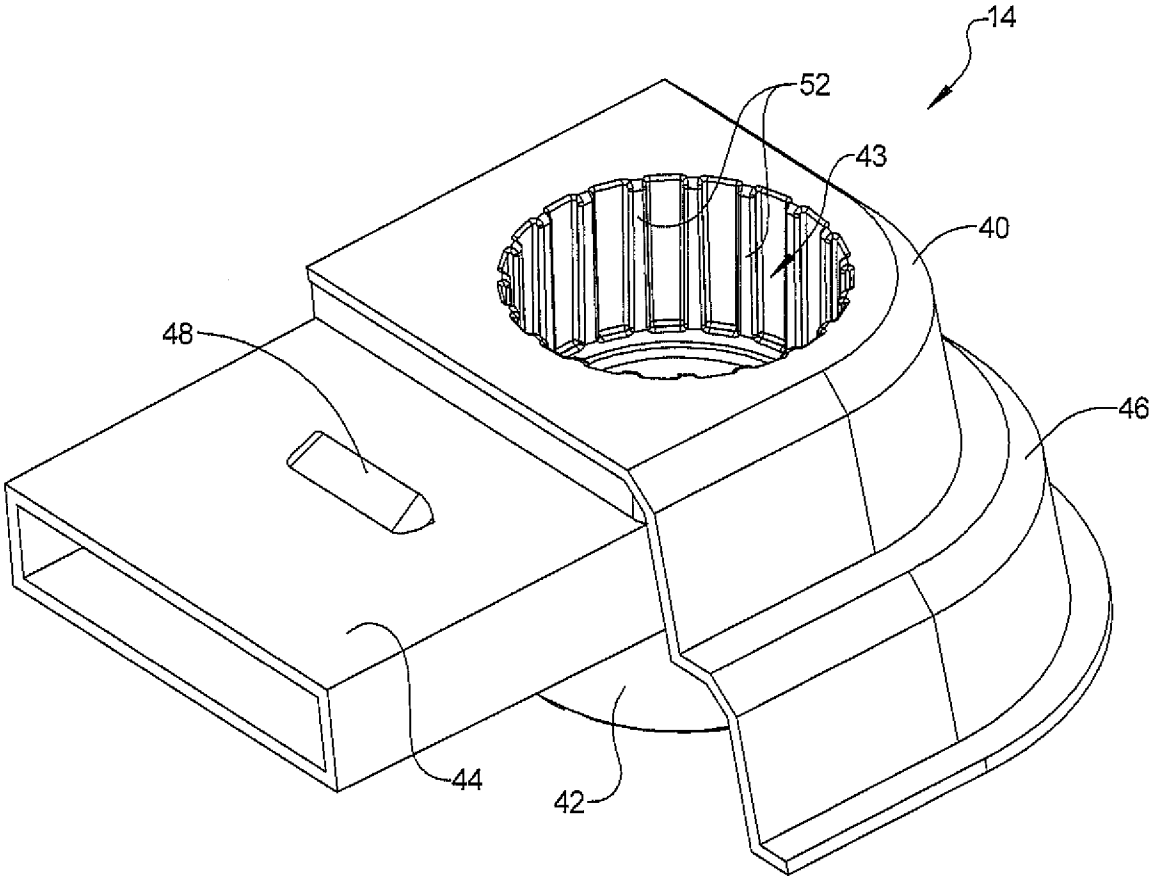
FIG. 9 is a top left perspective view of a corner connector of the shelf assembly shown in FIGS. 1-6.

Referring now to FIGS. 9-10 and 12, an insert 44 of the corner connector 14 integrally connects to and extends outwardly away from the housing 40. The insert 44 is configured for engaging with the shelf main body 12. The insert 44 is tubular and has a shape substantially corresponding to a shape of the opening 30 of the shelf main body 12. The openings 30 of the shelf main body 12 adjacent the second walls 20 therefore act as a sleeve to receive the insert 44.

With continuing reference to FIGS. 9-10, the insert 44 may have a wedge shaped key 48 extending outwardly therefrom. The key 48 ramps or angles upwardly from the insert 44 toward a flat edge 49 facing the housing 40 and is configured to engage with a slot 50 formed in the platform 16, with the edge 49 helping to prevent release of the insert 44. In the aspect illustrated in FIG. 10, the slot 50 is rectangular shaped and is formed as an aperture in the reinforcing portion 32 of the shelf main body 12. When the key 48 is engaged in the slot 40 as shown in FIG. 10, the ribs 34 facilitate both to conceal and to protect against the key 48 being displaced and thereby releasing the corner connector 14 from the shelf main body 12.

In certain aspects, further fastening means are employed to selectively engage the corner connectors 14 with the shelf main body 12. As illustrated in FIGS. 11-12, the further fastener means can include, for example, male extending snaps 56 disposed on an inner surface 58 of the outer wall 46 of the housing 40 which extend outwardly therefrom. Individual snaps 56 are configured to align and engage with individual notches 60 formed on the shelf main body 12.

In the aspect illustrated in FIGS. 11-12, there are two snaps 56 disposed on the inner surface 58 of the outer wall 46 of the corner connector 14. A first one of the snaps 56*a* is configured to align and engage with one notch 60*a* formed on one of the first walls such as first wall 18*b* of the shelf main body 12. A second one of the snaps 56*b* is configured to align with and engage with another notch 60*b* formed on one of the second walls 20 such as second wall 20*a* of the shelf main body 12. In other examples, more than two snaps can be employed. Other fastening means used either together with, or in place of, the snaps and notches, including a cam and groove system, or retaining pins, for example, may also be used within the scope of the present disclosure.

To assemble the shelf assembly 10, each of the corner connectors 14 are coupled to the shelf main body 12. To couple the corner connectors 14 to the shelf main body 12, each of the inserts 44 of the corner connectors 14 are slidingly disposed in the corresponding recesses 24 of the first walls 18 of the shelf main body 12. The insert 44 is received through the opening 30 at the recess 24 and the key 48 of the insert 44 engages with the slot 50 formed in the platform 16. Concurrently, the snaps 56 align and engage with the notches 60 to facilitate securing the corner connectors 14 to the shelf main body 12.

In FIGS. 13A-13D, a customizable assembly kit 70 for assembling modular shelving systems using shelf assemblies 10 is illustrated. The kit 70 includes a plurality of shelf main bodies 12 stacked in a nested configuration, and multiple corner connectors 14 for assembling multiple shelf assemblies 10. The corner connectors 14 can be releasably connected to the shelf main bodies 12 after removing the shelf main bodies 12 from the nested configuration. The kit 70 can also include other components for assembling the modular shelving system such as additional coupling means, connectors, and other shelving materials, as desired. For example, the kit 70 can include posts 72 for supporting the shelf assemblies 10. One of ordinary skill in the art may provide additional components for the kit 70, as desired.

Advantageously, and as illustrated in FIGS. 7 and 13, the shelf main bodies 12 can nest partially within each other when stacked in the nested configuration. This nesting facilitates a compactness of the kit 70 during transportation or storage because the corner connectors 14 are not in their installed positions when the shelf main bodies 12 are stacked. In the aspect illustrated in FIGS. 13A-13B, the shelf main bodies 12 are stacked for transportation so that the lower surface 17 of each platform 16 is facing upwardly. The corner connectors 14 and the posts 72 can then be stacked atop the nested shelf main bodies 12. The partitions 36 and the box supports 28 may also retain the corner connectors 14 and posts 72 on an uppermost one of the shelf main bodies 12 during storage and transport.

While certain representative aspects and details have been shown for purposes of illustrating the invention, it will be apparent to those skilled in the art that various changes may be made without departing from the scope of the disclosure, which is further described in the following appended claims.

What is claimed is:

1. A shelf assembly, comprising:

a shelf main body having a first wall and a second wall, the first wall transversely positioned with respect to the second wall, the shelf main body including a platform and a plurality of hollow box supports extending downwardly from a lower surface of the platform, wherein a receiving portion is formed at a corner of the shelf main body, a first side of the receiving portion defined by a terminal portion of the first wall and one of the box supports, a second side of the receiving portion defined by a terminal portion of the second wall and the platform, the first side of the receiving portion transversely positioned with respect to the second side of the receiving portion, the receiving portion including a recess formed in the one of the box supports; and a corner connector releasably coupled to the shelf main body at the receiving portion, the corner connector removably received by the recess of the receiving portion of the shelf main body and configured to receive at least one post, wherein the first wall and the second wall individually extend from the platform at an outwardly extending angle, the angle facilitating a nesting of the shelf main body with another successive shelf main body.

2. The shelf assembly of claim 1, wherein the first wall is one of an opposing pair of first walls, and the box supports extend between and are oriented substantially normal to the opposing pair of first walls.

3. The shelf assembly of claim 1, wherein the corner connector includes an insert that is removably received in the recess of the receiving portion of the shelf main body.

4. The shelf assembly of claim 3, wherein the insert is tubular and has a shape substantially corresponding to a shape of the recess of the receiving portion of the shelf main body.

5. The shelf assembly of claim 2, wherein the shelf main body includes a plurality of spaced apart ribs extending outwardly and upwardly from an upper surface of the platform, each of the spaced apart ribs aligned with one of the plurality of the hollow box supports, disposed between the opposing pair of first walls, and oriented substantially parallel with the opposing pair of first walls.

6. A shelf assembly, comprising:

a shelf main body having a first wall and a second wall, the first wall transversely positioned with respect to the second wall, the shelf main body including a platform and a plurality of hollow box supports extending downwardly from a lower surface of the platform, wherein a receiving portion is formed at a corner of the shelf main body, a first side of the receiving portion defined by a terminal portion of the first wall and one of the box supports, a second side of the receiving portion defined by a terminal portion of the second wall and the platform, the first side of the receiving portion transversely positioned with respect to the second side of the receiving portion, the receiving portion including a recess formed in the one of the box supports; and a corner connector releasably coupled to the shelf main body at the receiving portion, the corner connector removably received by the recess of the receiving portion of the shelf main body and configured to receive at least one post, wherein the shelf main body further includes partitions extending downwardly from the lower surface of the platform and interposed between each of the box supports.

7. The shelf assembly of claim 1, wherein the corner connector includes:

a housing with an inner wall, the inner wall defining an aperture configured to receive and support the at least one post; and an outer wall that partially envelopes the inner wall, the outer wall configured to align with each of the first wall and the second wall of the shelf main body when the corner connector is releasable coupled to the receiving portion of the shelf main body.

8. The shelf assembly of claim 7, wherein the inner wall includes protuberances formed thereon, the protuberances being elongate raised strips oriented substantially vertically when the corner connector is coupled to the shelf main body.

9. The shelf assembly of claim 8, wherein the protuberances facilitate a friction fit between the inner wall and the at least one post.

10. A shelf assembly, comprising:

a shelf main body having a first wall and a second wall, the first wall transversely positioned with respect to the second wall, the shelf main body including a platform and a plurality of hollow box supports extending downwardly from a lower surface of the platform, wherein a receiving portion is formed at a corner of the shelf main body, a first side of the receiving portion defined by a terminal portion of the first wall and one of the box supports, a second side of the receiving portion defined by a terminal portion of the second wall and the platform, the first side of the receiving portion transversely positioned with respect to the second side of the receiving portion, the receiving portion including a recess formed in the one of the box supports; and a corner connector releasably coupled to the shelf main body at the receiving portion, the corner connector removably received by the recess of the receiving portion of the shelf main body and configured to receive at least one post, wherein the corner connector includes a housing with an inner wall, the inner wall defining an aperture configured to receive and support the at least one post, and an outer wall that partially envelopes the inner wall, the outer wall configured to align with each of the first wall and the second wall of the shelf main body when the corner connector is releasable coupled to the receiving portion of the shelf main body, and wherein the inner wall further includes a ledge formed thereon, which extends radially inwardly from the inner wall, the ledge separating the aperture into an upper portion and a lower portion, the upper portion of the aperture configured for receiving an end of one of the at least one post, and the lower portion of the aperture configured for receiving an end of another of the at least one post.

11. The shelf assembly of claim 7, wherein the corner connector further includes an insert integrally connected to and extending outwardly away from the housing, the insert removably received in the recess of the receiving portion of the shelf main body.

12. A shelf assembly, comprising:

a shelf main body having a first wall and a second wall, the first wall transversely positioned with respect to the second wall, the shelf main body including a platform and a plurality of hollow box supports extending downwardly from a lower surface of the platform, wherein a receiving portion is formed at a corner of the shelf main body, a first side of the receiving portion defined by a terminal portion of the first wall and one of the box supports, a second side of the receiving portion defined by a terminal portion of the second wall and the platform, the first side of the receiving portion transversely positioned with respect to the second side of the receiving portion, the receiving portion including a recess formed in the one of the box supports; and a corner connector releasably coupled to the shelf main body at the receiving portion, the corner connector removably received by the recess of the receiving portion of the shelf main body and configured to receive at least one post, wherein the corner connector includes a housing with an inner wall, the inner wall defining an aperture configured to receive and support the at least one post, and an outer wall that partially envelopes the inner wall, the outer wall configured to align with each of the first wall and the second wall of the shelf main body when the corner connector is releasable coupled to the receiving portion of the shelf main body, wherein the corner connector further includes an insert integrally connected to and extending outwardly away from the housing, the insert removably received in the recess of the receiving portion of the shelf main body, wherein the insert includes a wedge shaped key extending outwardly therefrom, the key angling upwardly from the insert toward a flat edge facing the housing and configured to engage with a slot formed in the shelf main body, with the edge acting to militate against release of the insert from the slot.

13. A shelf assembly, comprising:

a shelf main body having a first wall and a second wall, the first wall transversely positioned with respect to the second wall, the shelf main body including a platform and a plurality of hollow box supports extending downwardly from a lower surface of the platform, wherein a receiving portion is formed at a corner of the shelf main body, a first side of the receiving portion defined by a terminal portion of the first wall and one of the box supports, a second side of the receiving portion defined by a terminal portion of the second wall and the platform, the first side of the receiving portion transversely positioned with respect to the second side of the receiving portion, the receiving portion including a recess formed in the one of the box supports; and a corner connector releasably coupled to the shelf main body at the receiving portion, the corner connector removably received by the recess of the receiving portion of the shelf main body and configured to receive at least one post, wherein the corner connector includes a housing with an inner wall, the inner wall defining an aperture configured to receive and support the at least one post, and an outer wall that partially envelopes the inner wall, the outer wall configured to align with each of the first wall and the second wall of the shelf main body when the corner connector is releasable coupled to the receiving portion of the shelf main body, wherein the shelf main body includes individual notches formed therein, and the corner connector further includes male extending snaps disposed on an inner surface of the outer wall of the housing and which extend outwardly from the outer wall, individual ones of the snaps configured to align with and engage the notches formed on the shelf main body.

14. A kit for a shelf assembly, comprising:

a plurality of shelf main bodies, the shelf main bodies arranged in a nested configuration with each other, wherein the shelf main bodies each include a platform with a lower surface having a plurality of hollow box supports extending from the platform, and multiple partitions individually defining reinforcing walls interposed between each of the box supports;

a plurality of posts arranged atop the lower surface of an uppermost one of the shelf main bodies arranged in the nested configuration; and a plurality of corner connectors arranged atop the lower surface of an uppermost one of the shelf main bodies arranged in the nested configuration, the corner connectors connectable to the shelf main bodies after the shelf main bodies are removed from the nested configuration, and the corner connectors connectable to the posts to the posts after the posts are removed from the uppermost one of the shelf main bodies, wherein in the nested configuration the partitions and the box supports of the uppermost one of the shelf main bodies removably retain the corner connectors and the posts on the lower surface of the uppermost one of the shelf main bodies.

15. The kit for a shelf assembly of claim 14, wherein each of the shelf main bodies is stacked in the nested configuration so that the lower surface of each platform is facing upwardly.

* * * * *